US007357617B2

(12) United States Patent
Haga et al.

(10) Patent No.: US 7,357,617 B2
(45) Date of Patent: Apr. 15, 2008

(54) FAN INCLUDING A PLURALITY OF SPACED FAN BODIES

(76) Inventors: Johan Haga, Holtevn. 21, Kolbotn (NO) N-1410; Nils Haga, Kappvn. 5, Oppegård (NO) N-1415; Thomas Haga, Holtevn. 21, Kolbotn (NO) N-1410

( * ) Notice: Subject to any disclaimer, the term of this patent is extended or adjusted under 35 U.S.C. 154(b) by 0 days.

(21) Appl. No.: 10/566,168

(22) PCT Filed: Jul. 29, 2004

(86) PCT No.: PCT/NO2004/000231

§ 371 (c)(1),
(2), (4) Date: Mar. 27, 2006

(87) PCT Pub. No.: WO2005/017363

PCT Pub. Date: Feb. 24, 2005

(65) Prior Publication Data

US 2006/0188365 A1 Aug. 24, 2006

(30) Foreign Application Priority Data

Jul. 31, 2003 (NO) ..... 20033427

(51) Int. Cl.
*F04D 17/08* (2006.01)
*F04D 29/28* (2006.01)
*F04D 29/62* (2006.01)
*F25D 17/06* (2006.01)

(52) U.S. Cl. ..... 415/99; 415/198.1; 416/198 R

(58) Field of Classification Search ..... 415/90, 415/98, 99, 100, 198.1; 416/185, 198 R; 17/90, 98, 99, 100, 198.1
See application file for complete search history.

(56) References Cited

U.S. PATENT DOCUMENTS 1,328,679 A * 1/1920 Leonard ..... 415/94
1,546,323 A * 7/1925 Spowage ..... 415/98

(Continued)

FOREIGN PATENT DOCUMENTS

CH 541078 10/1973

(Continued)

*Primary Examiner*—Edward K. Look
*Assistant Examiner*—Nathan Wiehe
(74) *Attorney, Agent, or Firm*—Christian Abel

(57) ABSTRACT

A fan including a plurality of spaced fan bodies that rotate in a substantially cylindrical cavity having inlet and outlet openings for tangential intake and discharge of the fluid, the fan bodies comprising substantially disc-shaped bodies that extend in a substantially radial direction from the shaft and are positioned on the shaft such that the shaft runs through the centre of the fan bodies and in such a manner that a void is formed between two neighbouring fan bodies, and wherein each fan body is connected to the shaft or to a spacer only, and wherein the fan bodies are provided with flow elements on both of their radially extending faces, the flow elements consisting of curved projections, the curved projections being curved forwardly as compared to the direction of rotation of the fan bodies and the curved projections extending between two imaginary circles on the fan bodies' radially extending faces having radii r1 and r2 respectively, wherein r1<r2, the radius r1 is larger than the outer radius of the shaft or the outer radius of spacers if spacers are provided, and r2 is substantially coincident with the fan bodies' circumference.

6 Claims, 5 Drawing Sheets

U.S. PATENT DOCUMENTS

| | | | | | |
|---|---|---|---|---|---|
| 3,275,223 | A | * | 9/1966 | Fowell | 415/53.1 |
| 4,412,783 | A | | 11/1983 | Barlass | |
| 4,902,199 | A | | 2/1990 | McDonald | |
| 5,240,371 | A | * | 8/1993 | Belomestnov | 415/53.1 |
| 5,388,958 | A | * | 2/1995 | Dinh | 416/90 |
| 5,427,503 | A | * | 6/1995 | Haraga et al. | 416/223 B |
| 5,536,140 | A | * | 7/1996 | Wagner et al. | 415/119 |
| 5,588,803 | A | | 12/1996 | Vetter | |
| 5,901,568 | A | | 5/1999 | Haga | |
| 2002/0047506 | A1 | | 4/2002 | George | |
| 2002/0094005 | A1 | | 7/2002 | Partlo | |

FOREIGN PATENT DOCUMENTS

| | | |
|---|---|---|
| EP | 381758 | 8/1990 |
| EP | 697574 | 2/1996 |
| GB | 1001153 | 8/1965 |
| WO | WO0204871 | 1/2002 |

* cited by examiner

A—A

FAN INCLUDING A PLURALITY OF SPACED FAN BODIES

The present invention relates to a fan including a plurality of spaced fan bodies for obtaining circulation of air.

In several applications there is a need for a cold or warm curtain of air, for example, to ensure adequate chilling of food products in a refrigerated or freezer counter. Other instances may be a refrigerated truck, container or other type of cabinet where it is essential to maintain a constant temperature across a large surface. Other applications may be the cooling of physical machine elements such as electronic machines, computers etc.

In the case of refrigerated or freezer counters, this need has usually been met by installing a plurality of individual fans at regular intervals in the longitudinal direction of the refrigerated or freezer counter. In spot cooling of this kind, a relatively large amount of power is used as it is also necessary to obtain sufficient cooling at points between two fan elements, and an even distribution of air is only obtained at some distance from the fans. Each fan-element must also have a drive unit. Spot cooling of this kind involves a large number of separate units in the system which must be controlled, maintained and possibly replaced, and this is both time-consuming and expensive. One example of such a solution is taught in U.S. 02/0047506, (FIG. 1), where fan elements are arranged at certain points at both the top and the bottom of a refrigerated counter.

A device which will provide an improvement is taught in, for example, U.S. 02/0094005 and EP 0697574, which teach elongate fans, which thus no longer provide a spot circulation effect, but which establish a uniform air curtain. These elongate fans all have blade-like elements arranged in essentially the longitudinal direction of the fan, optionally with stiffeners/attachment means at regular intervals along the axis of the fan, that is to say continuously in the longitudinal direction of the fan.

These fans have the disadvantage that they are not particularly easily adaptable to any fluid curtain length that may be required.

Another problem is that these fans are only able to work at a certain airflow inlet and outlet direction, and cannot easily be adapted to the requirements of other flow directions. Problems associated with the intake of air into the fan device are often encountered in existing fan devices.

One of the objects of the present invention is to provide a fan which produces good, uniform air circulation over a substantial distance in the immediate vicinity of the fan outlet. It is also an object to provide a fan which can very easily be adapted to the individual site of use both as regards the width across which the fan is to provide a uniform airflow, and which is simple and inexpensive to produce.

Yet another object is to obtain a fan which can easily be adapted to the relevant need for an air pattern from the fan with respect to diffusivity or centricity. At the same time, it is an object to obtain a fan that is quiet and where cleaning and maintenance costs run at a minimum.

It is also an object to provide a fan device with good intake capacity, and which can easily be adjusted in relation to the inlet and outlet direction of the airflow, thereby giving the fan a greater area of application.

The device comprises a shaft provided with a plurality of fan bodies, arranged in a cavity. The fan bodies in their basic form are substantially disc-shaped and extend in a substantially radial direction relative to a rotational axis. The fan bodies have a thickness in the axial direction and have a greater extent in the radial direction than in the axial direction, with the result that they are disc-shaped. The shaft runs through the centre of the fan bodies. The length of the shaft and the number of fan bodies can be varied depending on the site of use of the device and the desired output/capacity.

The fan bodies, in their basic form, are preferably substantially rotational-symmetrical about their centre and arranged essentially at right angles to the shaft. The fan bodies are preferably spaced apart. Other designs are also possible where the discs at their outer edge have forms other than rotational-symmetrical and/or they are arranged at an angle relative to the shaft in the fan.

The fan bodies have on or in their substantially radial surfaces flow elements which promote better air circulation. These flow elements may be of different types, and one fan body/fan may have one type or a combination of different types of flow elements.

The flow elements consist preferably of at least one projection on the radial faces of the fan body. These projections can be obtained in a number of ways. They may either be made as a part of the fan element when this is, for example, cast, added later by being welded, glued or nailed in place or secured in some other manner, or obtained by inserting plate-like elements in through grooves in the fan body.

If the flow elements are grooves, these can be made in the surface later or be formed as a part of the fan body during the production thereof. Another variant for making grooves and/or projections may be to emboss them in the fan element.

These may be embossings which only affect one surface of the fan body or an embossing where grooves and projections on one of the substantially radially extending faces results in oppositely shaped grooves and/or projections on the other opposite substantially radially extending face of the fan body.

The number of flow elements and the shape thereof may contribute to the fan's degree of diffusivity or centricity of the airflow, and also have an effect on whether the fan creates negative pressure on one side or fan output on the other side. Essentially, such grooves and/or projections in the surface run radially outwards from a central area of the fan body towards the radially outer edge of the fan body. The grooves and/or projections may be substantially straight and run in a radial direction, or be substantially straight and run in a forward or backward direction, or be bent in an essentially radial forward or backward curved direction. If the projections are curved backwards relative to the direction of rotation, the fan can function as a pump, whilst a forward curvature of the projections relative to the direction of rotation gives an excellent fan output, that is to say, pressure is delivered on the rear side of the fan. Normally, grooves and/or projections will be distributed evenly around the circumference of the fan body.

In a preferred embodiment, the fan body is made having projections as flow elements. These projections are identical on both sides of the fan body and evenly distributed around the fan body. The projections extend preferably in a forward curve from a central portion of the fan body, having a radius r1, at an angle of about 90 degrees relative to a rotational tangent, to an outer radius r2 which corresponds to an outer point of the fan body, at an angle to the rotational tangent of about 50 degrees. A fan body may, for example, be made having 12 projections along its circumference, but other numbers of projections are also possible.

The fan bodies are preferably positioned on the shaft at intervals. Tests carried out have shown that doubling the space between the discs from 10 mm to 20 mm, that is to say that there was a 10 mm space between the outer points of the projections, resulted in about a 30% increase in the volume flow rate of the air on free outlet when the speed was kept constant. That means to say that a 200% space between 100% height of the flow elements gives a good flow result for the fan according to the invention.

The choice of materials for the shaft and the fan bodies will depend upon the area of application of the device. A device where the fan bodies have a diameter of a few centimetres, and where weight is important will naturally be made of a different material than a device where the fan bodies have a diameter of one metre. All types of material are possible for the whole or parts of the device, such metals, plastics, carbon and glass fibre etc.

The fan bodies can be arranged on the shaft in a number of ways and the method employed will also be dependent upon the choice of material for the parts. One possible way is to shrink-fit the fan bodies onto the shaft. Alternatively, they may be secured by welding, soldering, screwing or wedging. Spacers may be provided between the fan bodies so that they remain suitably spaced apart on the shaft. The spacers may be separate spacers that are introduced onto the shaft between each fan body, or they may be an integral part of the fan bodies, the bodies being formed with a projecting circular flange close to the centre of the fan body on one or both surfaces of the fan body. It is also possible that the fan bodies with spacers are fastened to each other, by welding, screw fastenings or snap-on connections, so that the fan bodies themselves form a part or the whole of the shaft of the device.

One method of mounting the fan is that the shaft is cut to the desired length for the use in question. The number of fan bodies having the desired surface is determined and introduced onto the shaft with optional intermediate spacers and secured to the shaft. The arrangement is installed in the cavity at the site of use by being fastened to a support and connected to a drive unit.

An alternative method for providing a fan according to the invention is to cast the device in a single piece, for example, by casting in one and the same operation a 10-metre long shaft with fan discs which each have a given pattern, ridges or shape, and then, for example, cutting the shaft to the desired length.

In a preferred embodiment, the shaft with the fan bodies is arranged in a cavity that is defined by a cover. However, it is possible for the cavity to consist of a cavity in other elements at the site of use or a combination of a cavity in other elements and a cover.

The cavity has essentially a tubular shape or alternatively a helical shape with closed ends and intake/outlet of air. The cavity can be made having a funnel-shaped inlet into the fan elements, and a diffuser-shaped outlet leading from the fan elements.

The invention also relates to use of the device in places where it is desirable to have a warm or cold air curtain that is obtained by circulation of air, for example, in refrigerated and freezer counters, containers, cabinets etc. If the fan device is to be installed in, for example, a refrigerated or freezer counter, the independent cover may be omitted, the structure of the refrigerated or freezer counter being provided with a cavity containing ducts for incoming and outgoing airflow which replaces the cover, and in which the fan device is mounted.

On account of the general radial extent of the fan bodies, the surfaces of the fan bodies will, because of the centrifugal forces during rotation, always remain clean and thus maintain an optimal output, even in environments filled with dust, pollen etc.

On account of its longitudinal extent and the shape of the fan bodies, the device will essentially circulate the air in a two-dimensional direction, and in general this results in little noise. Furthermore, the output of the device can largely be controlled by speed control of the shaft.

The described technology is scalable as regards both the radial and/or axial dimension of the individual fan body, and the assembly of a plurality of bodies on one shaft. In the following, the invention will be described by exemplary embodiments and references to the attached drawings, wherein.

Figure 1:
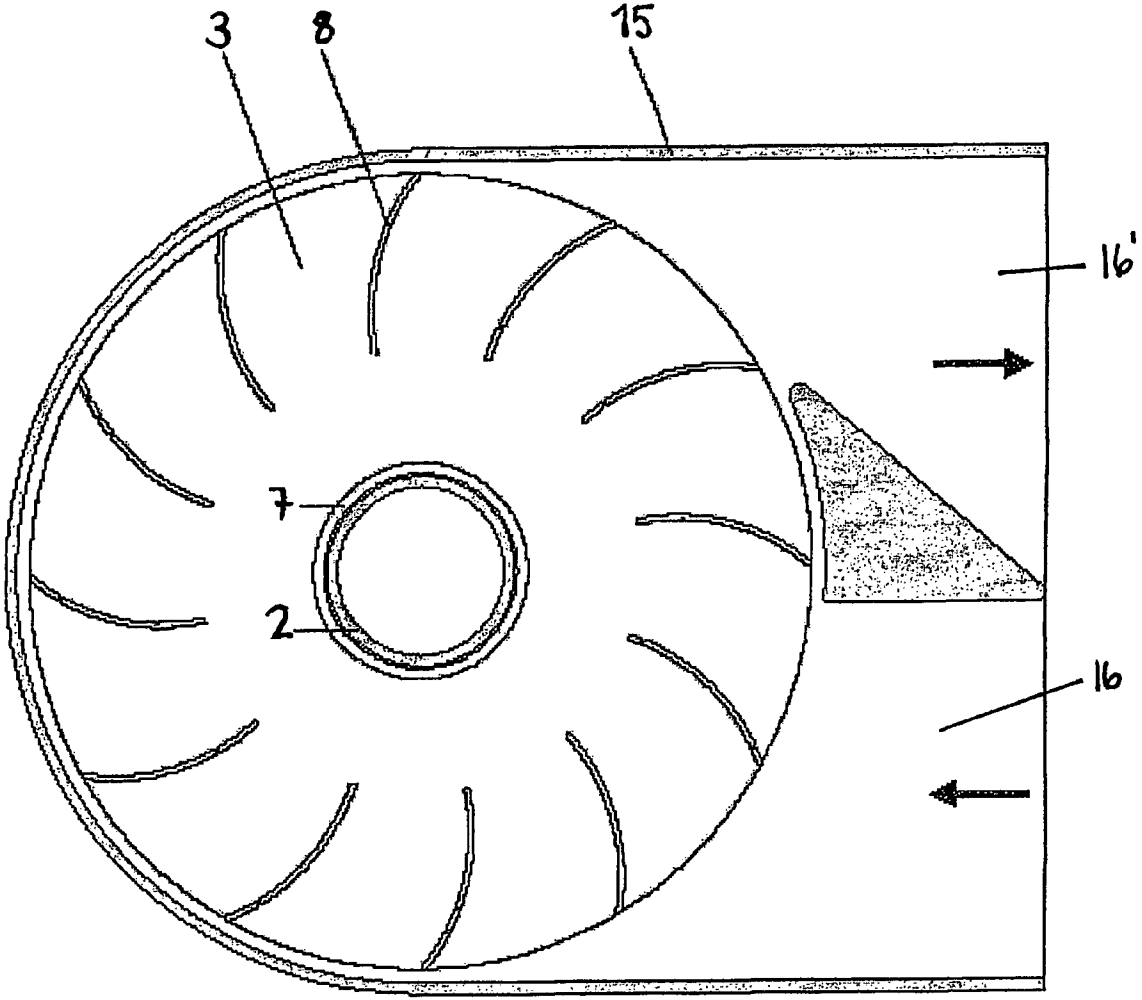
FIG. 1 shows in principle a cross-section of a fan body and shaft, surrounded by a cover.
Figure 2:
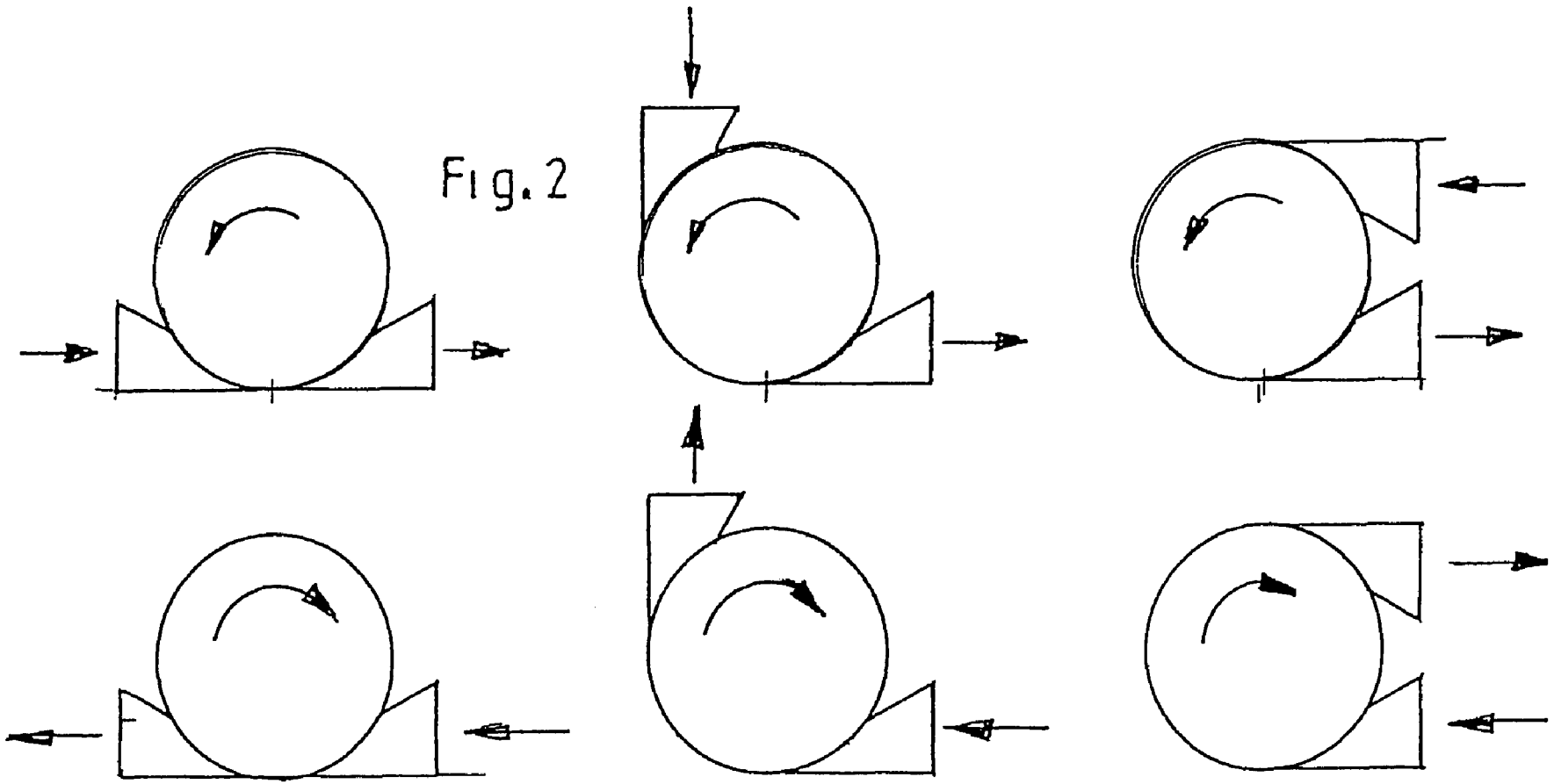
FIG. 2 shows drawings of a number of possible airflow directions for a fan according to the invention.

FIG. 1 shows in principle a section of a fan 1 according to the invention with fan body 3 mounted on a shaft 2, surrounded by a cover 15. The surrounding cover 15 is partly circular and equipped with a funnel-shaped inlet 16 which provides a tangential inlet into the fan wheels, and an outlet 16' which in the same way provides a tangential outlet out of the fan device. The tangential funnel-shaped inlet 16 can be located at any point on the circumference relative to the outlet 16', thereby permitting different flow directions which are adapted to the site of use in question as shown in FIG. 2.

Figure 3:
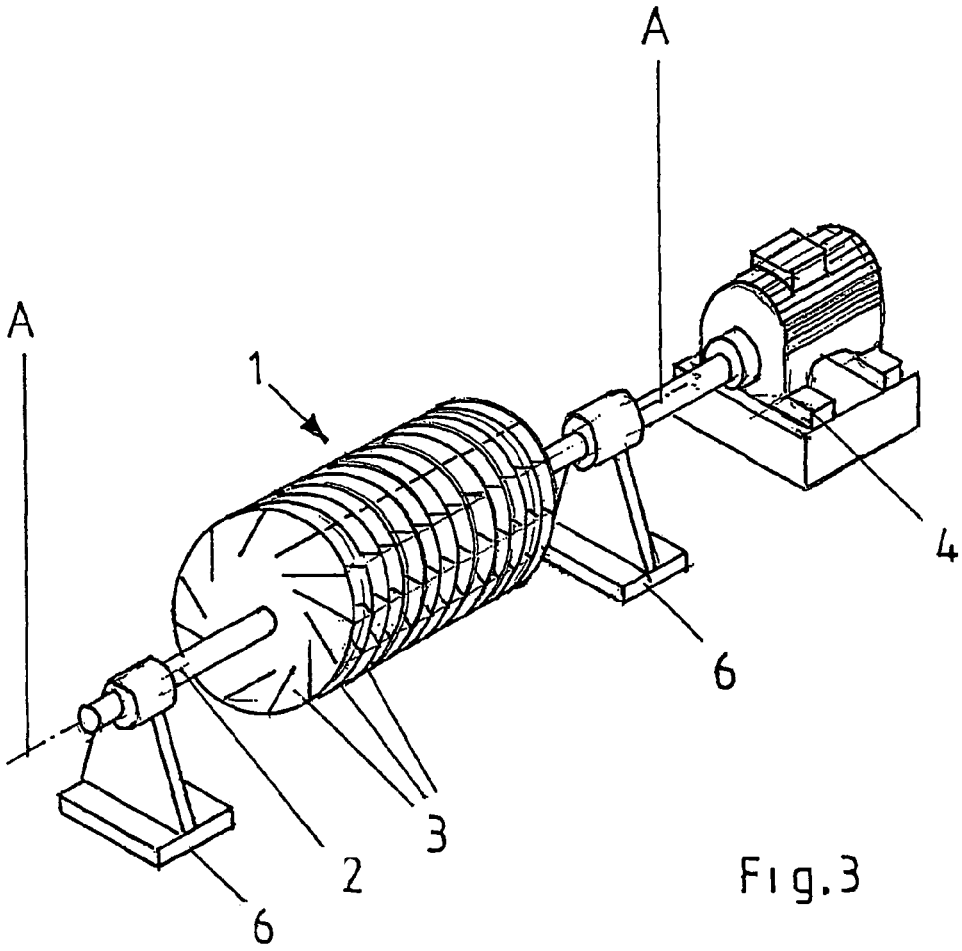
FIG. 3 is an isometric drawing of the elements of a fan, excluding the cover.

In FIG. 3 the cover 15 has been removed and further details of the fan 1 according to the invention are shown, including a plurality of fan bodies 3 mounted on shaft 2. The length of the shaft 2 and the number of fan bodies 3 are adapted to the site of use. Normally, the shaft 2 will be connected either directly, as shown in FIG. 3, or indirectly via transmissions to a drive unit 4. The shaft 2 will normally also be journalled in at least one bearing 5 which may be provided in a bracket 6 that is secured to a base.

Figure 4:
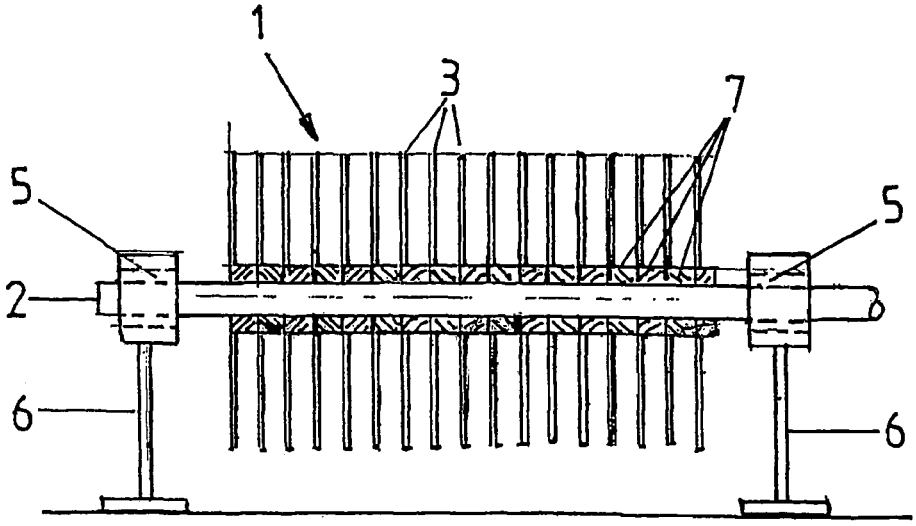
FIG. 4 is a longitudinal section taken along the line A-A in FIG. 3.

The fan bodies 3 in their basic form are substantially disc-shaped, and, as shown in FIG. 4, extend in a substantially radial direction with a smaller thickness in the axial direction than their extent in the radial direction. Spacers 7 may be provided between the fan bodies 3, either as separate parts or as an integral flange of the fan body.

The radially extending surfaces of the fan bodies 3, that is to say the surfaces facing the surface of a second fan body, may be equipped with flow elements 8. These may be in the form of grooves or preferably projections.

Figure 5:
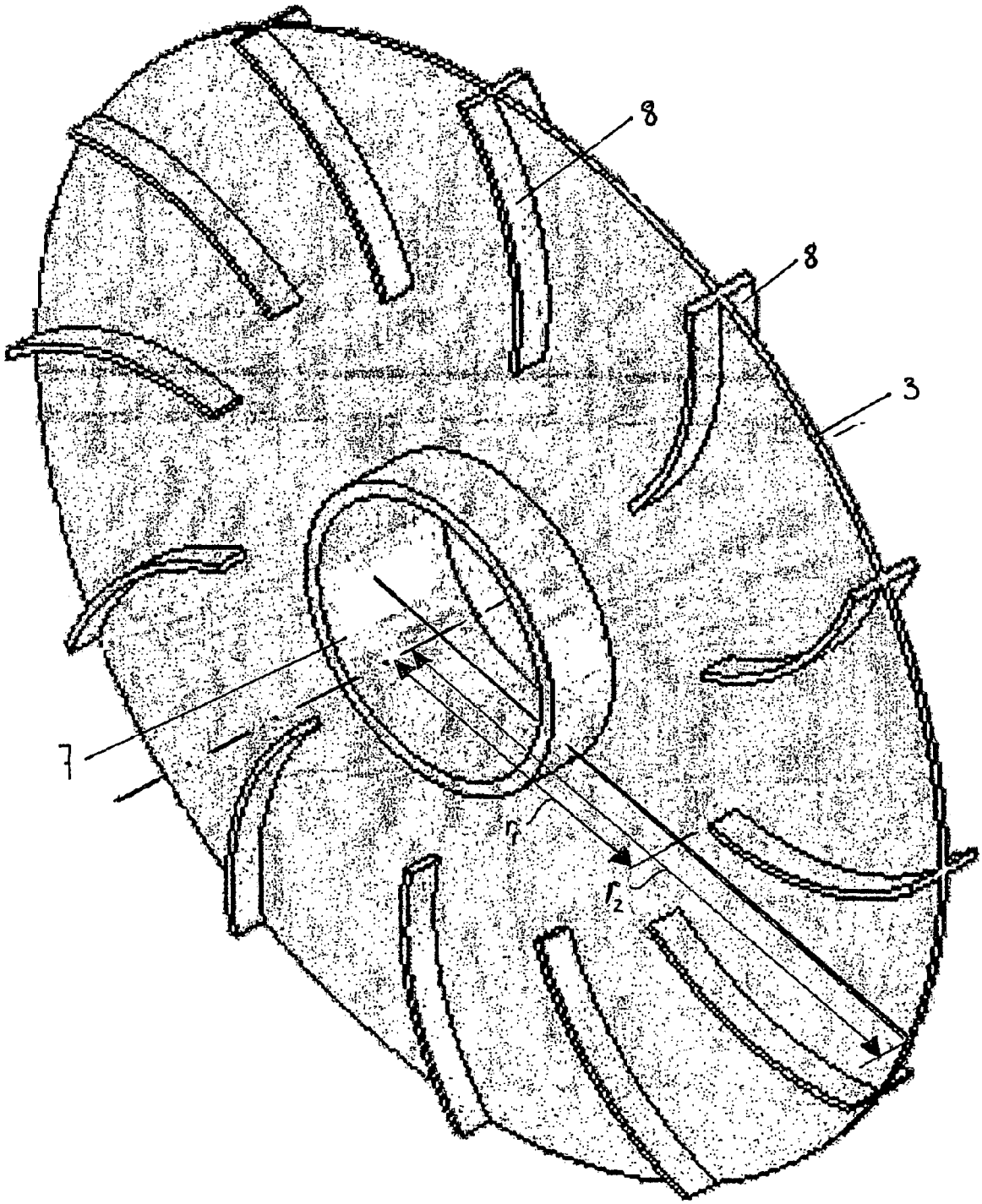
FIG. 5 is a perspective view of a preferred embodiment of a fan body.

In a preferred embodiment as shown in FIG. 5, the fan body 3 is made having 12 flow elements 8 on each side of the fan body 3. The flow elements 8 are projections that are substantially laminar, and which are given a forward directed curve from a starting point at a radius r1 to an outer point at a radius r2, which essentially corresponds to an outer point of the fan body 3. The inner radius r1 is some distance from a centre point of the fan body 3, which around its centre axis is made having a spacer 7 in the form of a flange. The projection 8 is made to extend in a forward curve which forms an angle of essentially 90 degrees relative to a rotational tangent at the inner radius r1 and which forms an angle of essentially 50 degrees with a rotational tangent at the outer radius r2.

Figure 6:
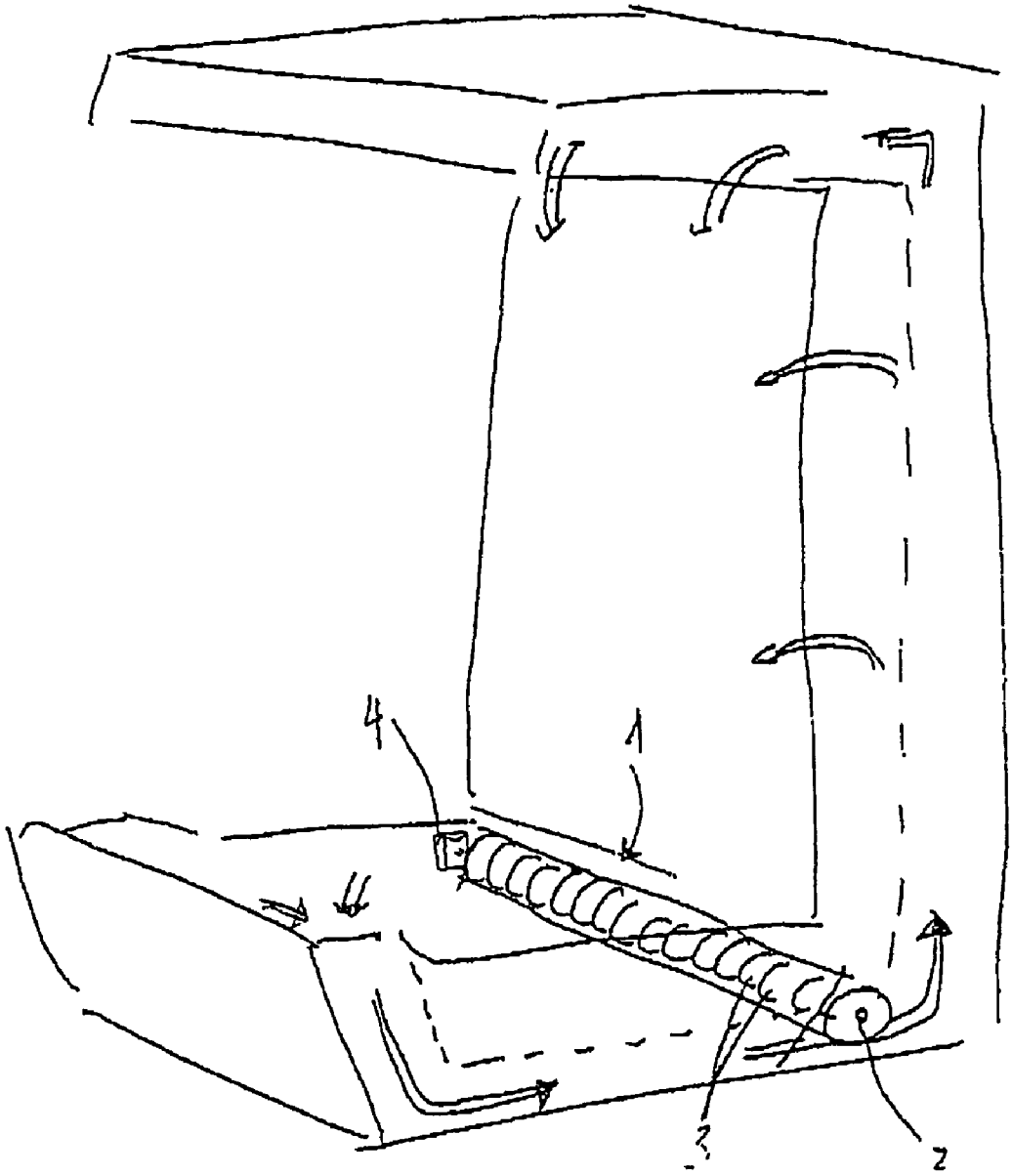
FIG. 6 shows a use of a fan according to the invention in a refrigerated counter.

The cover 15 with its substantially tubular shape may, for example, be made of an extruded tube, but the skilled person will be able to envisage many other ways of providing the cover. When the fan is mounted in, for example, a refrigerated counter, the independent cover 15 may be omitted if the structure of the refrigerated counter is made having a longitudinal circular cavity with inlet and outlet for the airflow which replaces the cover and in which the fan may be mounted. FIG. 6 shows a fan device mounted in a refrigerated counter.

With regard to the production of the device, several variants are possible. One variant is to produce shafts and fan bodies with or without separate spacers, whereupon at the installation site the shaft is cut to the right length, and the desired number of fan bodies with desired surface are mounted on the shaft and secured thereto, whereupon the arrangement is mounted at the site of use by being attached to a support and connected to a drive unit.

Alternatively, the device comprising a shaft and fan bodies is produced in prefabricated metre lengths. For installation at the site of use, the shafts are cut to the right length before being mounted on a bearing and connected to a drive unit. It is also possible for the shaft and fan bodies to be produced as a single unit, or for the shaft and fan bodies to be produced and assembled as a complete unit at the factory.

A device according to the invention has many areas of application ranging from refrigerated counters, as shown in FIG. 6, and large process plant fans to fan units in PC equipment, heaters and dryers. Rotating heat exchangers can be used in the foodstuff or process industry, district heating installations etc. Depending on its areas of use, the fan will vary greatly in size, from millimetres to metres. It will also be necessary to produce the device in different types of material depending on the areas of use. In those case where weight is important, the weight of the materials will be a critical factor. Alternatively, heat conductivity or strength may be important. Desires for specific flow elements or shapes thereof may also be decisive for the type of material chosen for the different parts of the device. Parts may be made of metal, plastic, carbon or glass fibre etc. The device may also be used both as an exhaust fan for gases and for fluid circulation. The invention has now been described by means of exemplary embodiments, but many variants of the invention within the field of knowledge of the skilled person are conceivable.

The invention claimed is:

1. A fan for obtaining circulation of a fluid comprising a shaft on which there is provided a plurality of fan bodies that rotate in a substantially cylindrical cavity having inlet and outlet openings for tangential intake and discharge of the fluid, the fan bodies comprising substantially disc-shaped bodies that extend in a substantially radial direction from the shaft and are positioned on the shaft such that the shaft runs through the centre of the fan bodies and in such a manner that a void is formed between two neighbouring fan bodies, and wherein each fan body is connected to the shaft or to a spacer only, and wherein the fan bodies are provided with flow elements on both of their radially extending faces, the flow elements consisting of curved projections, the curved projections being curved forwardly as compared to the direction of rotation of the fan bodies and the curved projections extending between two imaginary circles on the fan bodies' radially extending faces having radii r1 and r2 respectively, wherein r1 <r2, the radius r1 is larger than the outer radius of the shaft or the outer radius of spacers if spacers are provided, and r2 is substantially coincident with the fan bodies' circumference.

2. A fan according to claim 1, wherein the length of the shaft and the number of fan bodies can be varied depending upon the site of use of the device.

3. A fan according to claim 1, wherein the fan bodies (3) in their basic form are substantially rotational-symmetrical about their centre, are arranged essentially at right angles to the shaft (2) and with a distance between the fan bodies (3).

4. A fan according to claim 1, wherein the projection(s) run along a line of curvature that is curved forwards relative to the direction of rotation at an angle essentially equal to 90 degrees relative to a rotational tangent at r1, and an angle of 50 degrees relative to a rotational tangent at r2.

5. A fan according to one of claims 1, wherein the substantially tubular cavity, wherein the shaft rotates is defined by a cover with inlet and outlet openings.

6. A fan according to one of claims 1, wherein the tubular cavity, in which the shaft rotates, is formed as an integral part of the structure in which the fan device is to be mounted.

* * * * *